US010264897B1

(12) United States Patent
Chen

(10) Patent No.: US 10,264,897 B1
(45) Date of Patent: Apr. 23, 2019

(54) HANGING DECORATIVE ACCESSORY

(71) Applicant: Teng Kuei Chen, Taipei (TW)

(72) Inventor: Teng Kuei Chen, Taipei (TW)

( * ) Notice: Subject to any disclaimer, the term of this patent is extended or adjusted under 35 U.S.C. 154(b) by 0 days.

(21) Appl. No.: 15/919,344

(22) Filed: Mar. 13, 2018

(51) Int. Cl.

| | |
|---|---|
| ***G09F 1/12*** | (2006.01) |
| ***A44C 15/00*** | (2006.01) |
| ***A44C 25/00*** | (2006.01) |
| ***A47G 1/06*** | (2006.01) |
| ***A47G 1/16*** | (2006.01) |

(52) U.S. Cl.
CPC ..... *A47G 1/0616* (2013.01); *A44C 25/001* (2013.01); *A47G 1/16* (2013.01); *G09F 1/12* (2013.01)

(58) Field of Classification Search
CPC . A44C 15/0025; A44C 25/001; A44C 25/002; A44C 25/004; A44C 17/02; A44C 17/0208; A47G 1/0616; A47G 1/16; A47G 1/06; A47G 1/00; G09F 1/12
See application file for complete search history.

(56) References Cited

U.S. PATENT DOCUMENTS 6,550,166 B1 * 4/2003 Lyon ..... B60R 13/10 40/209

FOREIGN PATENT DOCUMENTS

FR 2627972 A1 * 9/1989 ..... A47G 1/06

* cited by examiner

*Primary Examiner* — Jack W Lavinder
(74) *Attorney, Agent, or Firm* — Pai Patent & Trademark Law Firm; Chao-Chang David Pai

(57) ABSTRACT

A hanging decorative accessory has a looped frame and a base card. The looped frame has an inner groove and multiple fixing segments. The periphery of the base card engages the inner groove of the looped frame and is fixed by the fixing segments to avoid detaching from the inner groove. For assembly, the user only needs to mount a side of the periphery of the base card between the abutting wall and the fixing segments of the looped frame, and then pushes the whole periphery into the inner groove of the looped frame to complete the assembly. Furthermore, as the hanging decorative accessory has a looped frame and a base card, the structure is simple and the hanging decorative accessory is still capable of being assembled firmly even though some components are missing.

12 Claims, 9 Drawing Sheets

HANGING DECORATIVE ACCESSORY

BACKGROUND OF THE INVENTION

1. Field of the Invention

The present invention relates to a hanging decorative accessory, particularly a hanging decorative accessory that has a base card fixed in a looped frame.

2. Description of the Prior Arts

With reference to FIG. 9, a conventional hanging decorative accessory includes two looped frames 41 and a base card 42. Each one of the two looped frames 41 is a round ring and has a hanging segment 411 mounted on an outer periphery of the looped frame 41. The base card 42 is mounted between the two looped frames 41. The two looped frames 41 abut each other and are fixed by multiple screws 43 to clamp the base card 42 between inner peripheries of the two looped frames 41.

A picture 421 can be printed on the above-mentioned base card 42 during manufacture. Then a user can decorate the picture 421 by applying some stickers that match the picture 421. For example, with reference to FIG. 9, the picture 421 on the base card 42 has a Christmas tree printed thereon. The user can decorate the Christmas tree by applying some stickers that match the Christmas tree, such as stickers of gift boxes, candies, socks, and crutches, and then enjoy the pleasure of decorating. After the decorating is completed, the base card 42 is clamped between the two looped frames 41. Then, the conventional hanging decorative accessory can be hanged on an appropriate place through the hanging segment 411.

The shortcomings of the conventional hanging decorative accessory is that the two looped frames 41 are fixed by screws 43, and the screws 43 are small and can be driven by a screwdriver only. Therefore, the conventional hanging decorative accessory is not suitable for children to play alone. Instead, the children need an adult to help them fix the two looped frames 41. Thus, the conventional hanging decorative accessory is not easy to use, and makes the children have less sense of accomplishment since they cannot do the decoration independently. Furthermore, the small screws 43 are prone to missing. Once a screw 43 is lost, the two looped frames 41 will not be assembled firmly, and even cannot be assembled at all.

To overcome the shortcomings, the present invention provides a hanging decorative accessory to mitigate or obviate the aforementioned problems.

SUMMARY OF THE INVENTION

The main objective of the present invention is to provide a hanging decorative accessory that can be assembled without tools.

The hanging decorative accessory has a looped frame and a base card. The looped frame has an inner groove and multiple fixing segments. The inner groove is formed in an inner looped surface of the looped frame, is formed through a back looped surface of the looped frame, and forms an abutting wall and an extending wall. The extending wall is located between the abutting wall and the back looped surface of the looped frame, and connects the abutting wall and the back looped surface of the looped frame. The multiple fixing segments are mounted on the extending wall of the inner groove and spaced apart from each other. Each one of the multiple fixing segments extends along the radial direction and is spaced apart from the abutting wall of the inner groove. The base card is mounted in the looped frame and has a periphery engaging the inner groove of the looped frame and mounted between the abutting wall and the fixing segments of the looped frame.

By the technical features mentioned above, the user only needs to mount a side of the periphery of the base card between the abutting wall and the fixing segments of the looped frame, and then pushes the whole periphery into the inner groove of the looped frame, and the assembly process is done without any tools such as a screwdriver. Even children can complete the assembly process themselves, and enjoy the sense of accomplishment about the independent work. Furthermore, as the hanging decorative accessory in the present invention only comprises a looped frame and a base card, the structure is simple and the present invention is still capable of being assembled even though some components are missing.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
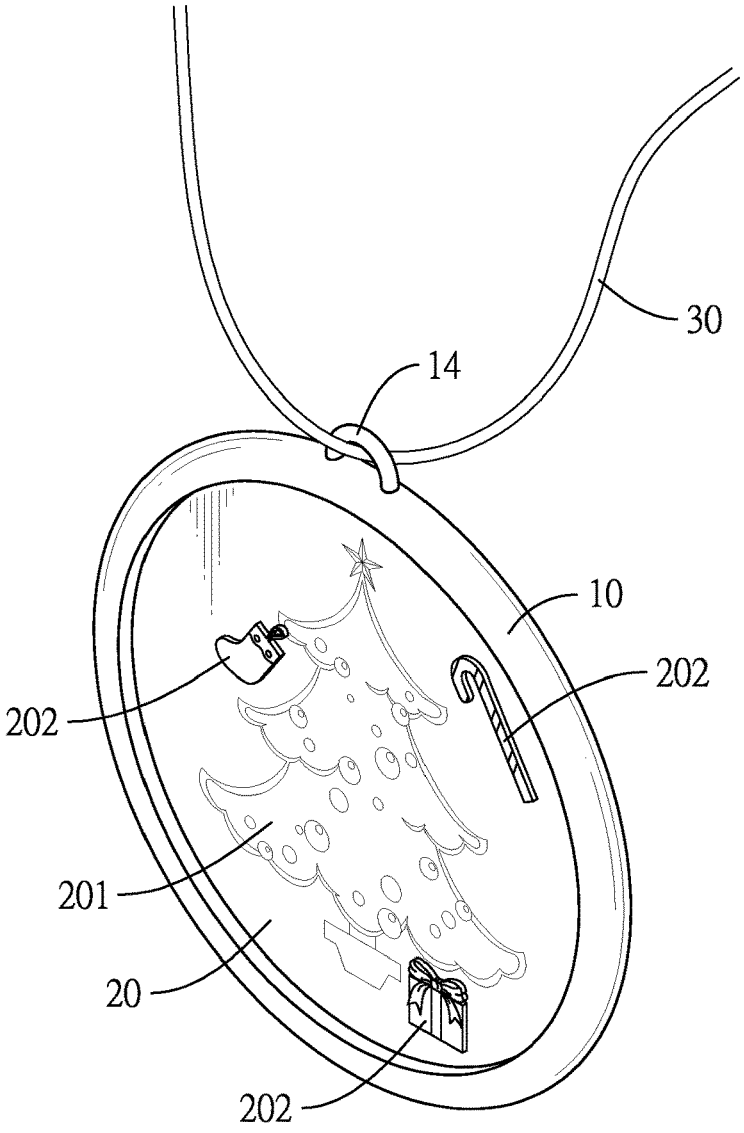
FIG. 1 is a perspective view of a hanging decorative accessory in accordance with the present invention.
Figure 2:
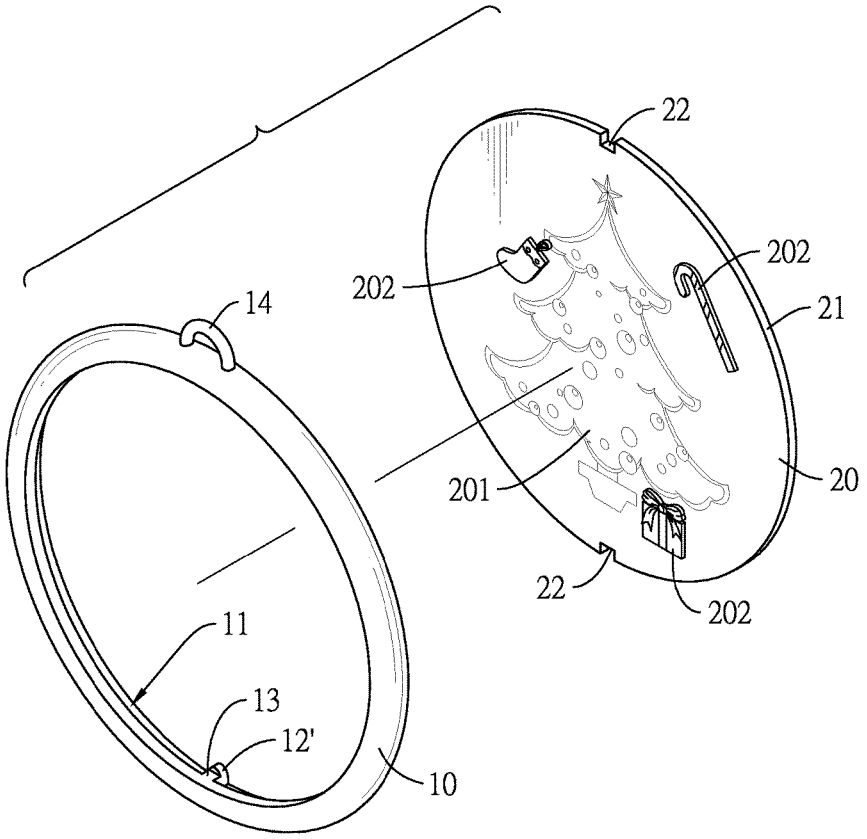
FIG. 2 is an exploded view of the hanging decorative accessory in FIG. 1.

With reference to FIGS. 1 and 2, a hanging decorative accessory in accordance with the present invention comprises a looped frame 10 and a base card 20.

Figure 3:
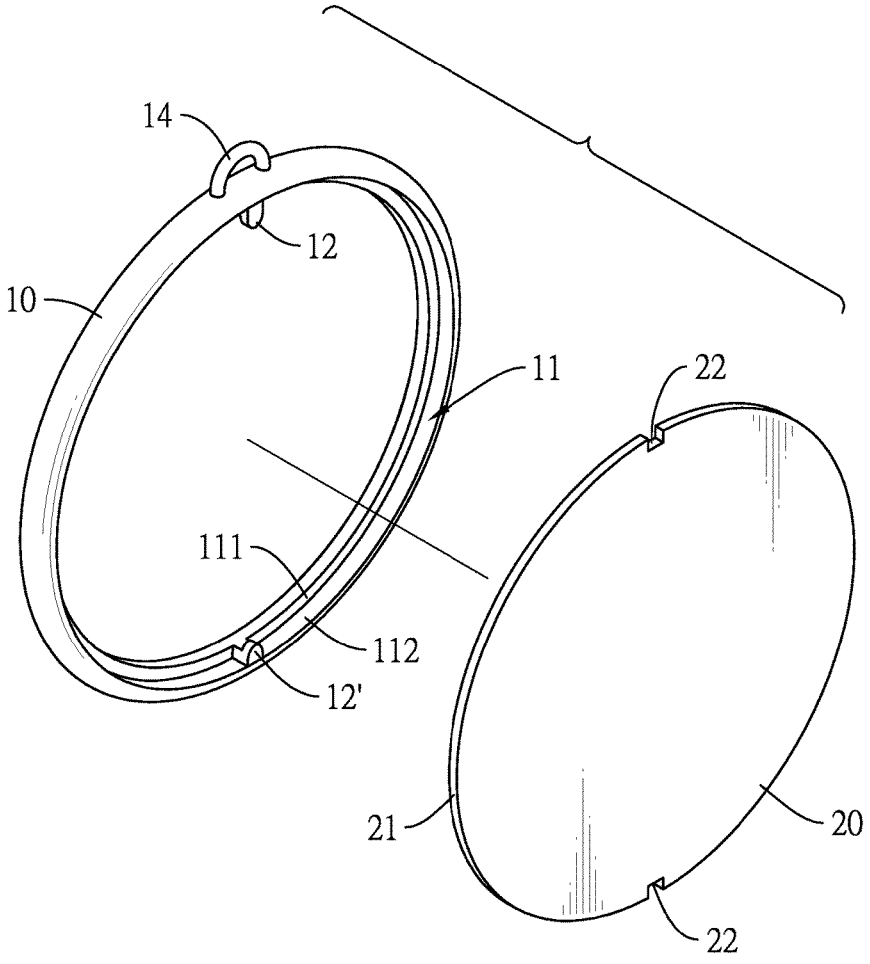
FIG. 3 is another exploded view of the of hanging decorative accessory in FIG. 1.
Figure 4:
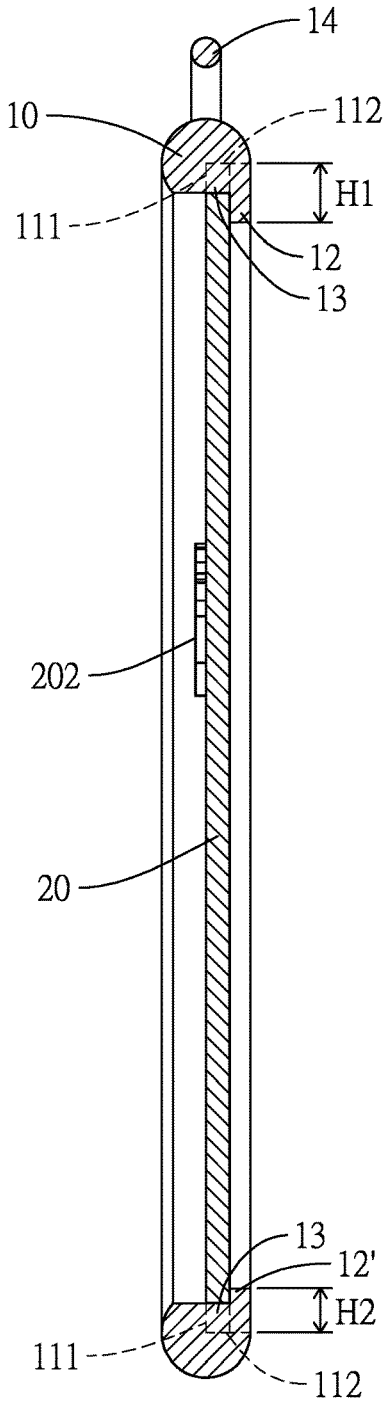
FIG. 4 is a side view in cross section of the hanging decorative accessory in FIG. 1.
Figure 5:
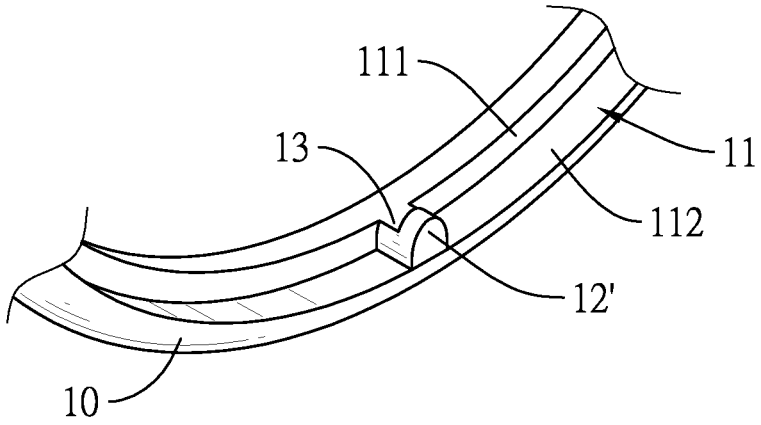
FIG. 5 is an enlarged perspective view of the hanging decorative accessory in FIG. 1, showing the looped frame.

With reference to FIGS. 3 to 5, the looped frame 10 has a back looped surface, an inner looped surface, an outer looped surface, an inner groove 11, multiple fixing segments 12, 12', and a hanging segment 14. The back looped surface is disposed in the back of the looped frame 10. The inner looped surface and the outer looped surface are respectively in the radial inner side and the radial outer side of the looped frame 10.

In a preferred embodiment, the looped frame 10 is preferably, but not limited to, an annular loop in shape. However, in another preferred embodiment, the looped frame 10 may be a rectangular loop in shape. That is, the looped frame 10, the back looped surface, the inner looped surface, and the outer looped surface, are not limited to circular loops but can be loops in any other shape.

The inner groove 11 is formed in the inner looped surface of the looped frame 10. The inner groove 11 is formed through the back looped surface of the looped frame 10 and forms an abutting wall 111 and an extending wall 112 in the inner groove 11. The extending wall 112 is located between the abutting wall 111 and the back looped surface of the looped frame 10, and connects the abutting wall 111 and the back looped surface of the looped frame 10. The fixing segments 12, 12' are mounted on the extending wall 112 of the inner groove 11 and spaced apart from each other. Each one of the fixing segments 12, 12' extends along a radial direction and is spaced apart from the abutting wall 111 of the inner groove 11. Furthermore, each one of the fixing segments 12, 12' is connected to the abutting wall 111 by a respective connecting segment 13. The hanging segment 14 is mounted on the outer looped surface of the looped frame 10. A hanging rope 30 is mounted through the hanging segment 14 in order to hang the hanging decorative accessory in accordance with the present invention on an appropriate place.

The base card 20 is mounted in the looped frame 10. The base card 20 has a front surface, a back surface, a periphery 21, and multiple notches 22. A picture 201 is printed on the front surface of the base card 20. A user can apply some stickers 202 that match the picture 201 on the base card 20. The notches 22 are formed in the periphery 21 of the base card 20. The notches 22 are spaced apart from each other and correspond in position to the fixing segments 12, 12' of the looped frame 10 respectively.

When the base card 20 is mounted in the looped frame 10, the periphery 21 of the base card 20 engages the inner groove 11 of the looped frame 10. The connecting segments 13 of the looped frame 10 engage the notches 22 of the base card 20 respectively. The front surface of the base card 20 abuts the abutting wall 111 of the looped frame 10. The back looped surface of the base card 20 abuts the fixing segments 12,12'. That is, the periphery 21 of the base card 20 is mounted in and clamped between the abutting wall 111 and the fixing segments 12,12' of the looped frame 10.

With the above-mentioned connecting segments 13 of the looped frame 10 engaging the notches 22 of base card 20, the base card 20 is mounted on the looped frame 10 at a specific angle, ensuring that the picture 201 printed on the base card 20 will not be disposed obliquely. Furthermore, the looped frame 10 can be produced by injection molding, and thus the connecting segments 13 make the looped frame 10 easier to demould.

With reference to FIGS. 3 and 4, in a preferred embodiment, the amount of the multiple fixing segments 12, 12' is two, and the two fixing segments 12,12' are located in two opposite positions on the looped frame 10 respectively. Each fixing segment 12,12' is connected to the abutting wall 111 by a respective connecting segment 13. Correspondingly, the amount of the notches 22 of base card 20 is also two, and the two notches 22 are located in two opposite positions on the periphery 21 of the base card 20 respectively. The connecting segments 13 engage the notches 22 respectively.

Preferably, a distance H1 that one of the fixing segments 12 extends along the radial direction is longer than a distance H2 that the other one of the fixing segments 12' extends along the radial direction. The user can mount a side of the periphery 21 of the base card 20 between the abutting wall 111 of the looped frame 10 and the fixing segment 12 which has the longer distance H1 at first, and then mount the other side of the periphery 21 of the base card 20 between the abutting wall 111 of the looped frame 10 and the fixing segment 12' which has the shorter distance H2 in order to make the base card 20 mounted stably in the looped frame 10.

Figure 6:
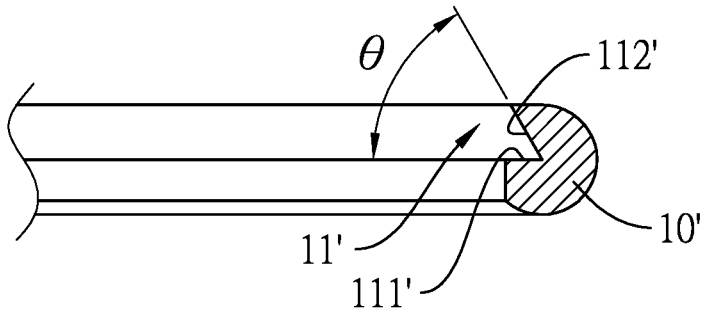
FIG. 6 is an enlarged side view in section in another embodiment of the hanging decorative accessory in FIG. 1, showing a looped frame of the hanging decorative accessory.

With reference to FIGS. 4 and 5, in a preferred embodiment, the abutting wall 111 is perpendicular to the extending wall 112 of the looped frame 10. With reference to FIG. 6, in another preferred embodiment, an angle θ between the abutting wall 111' and the extending wall 112' of the looped frame 10' is an acute angle to prevent the periphery 21 of the base card 20 detaching from the inner groove 11' of the looped frame 10'. The structure of the acute angle θ between the abutting wall 111' and the extending wall 112' can be produced by forced demoulding during the process of injection molding when producing the looped frame 10'.

Figure 7:
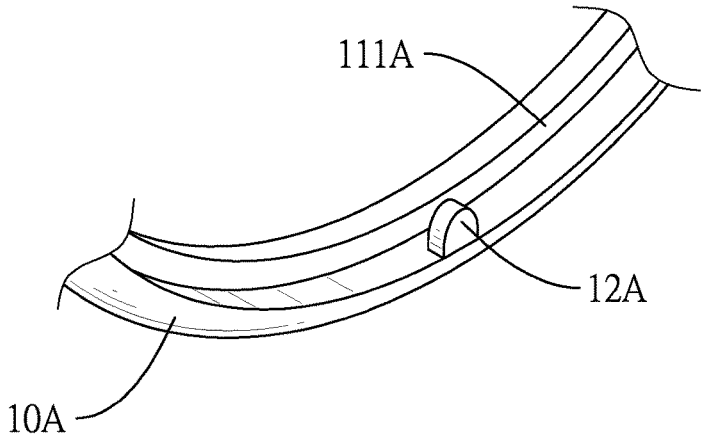
FIG. 7 is a side view in cross section in still another embodiment of the hanging decorative accessory in FIG. 1.
Figure 8:
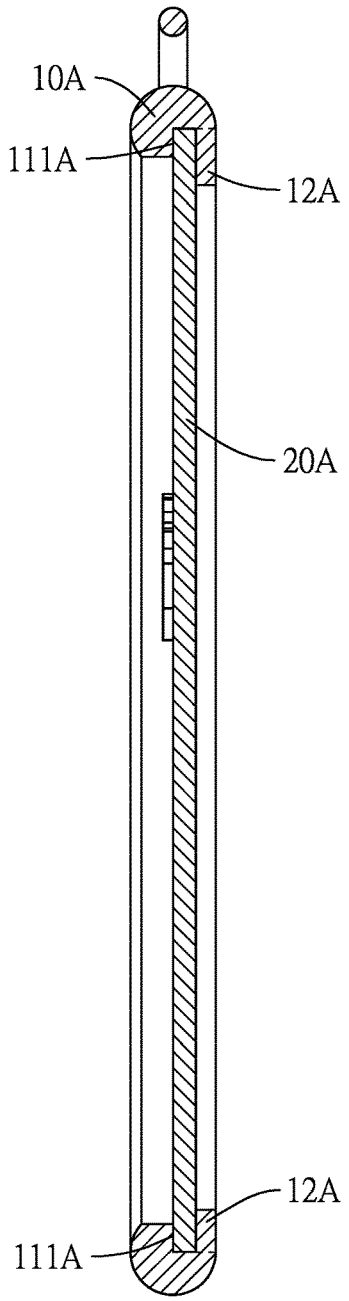
FIG. 8 is an enlarged perspective view in still another embodiment of the hanging decorative accessory in FIG. 1, showing the looped frame.
Figure 9:
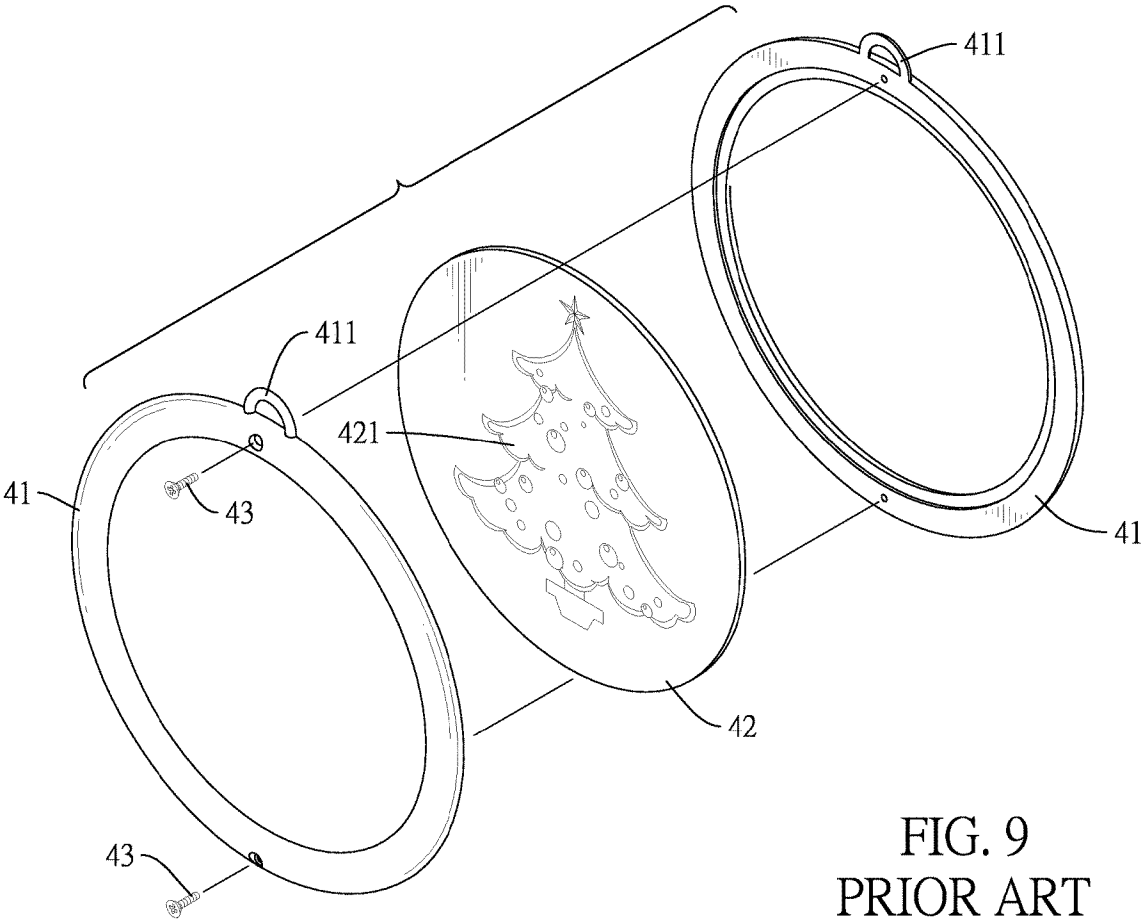
FIG. 9 PRIOR ART
FIG. 9 is an exploded view of a hanging decorative accessory in accordance with the prior art.

With reference to FIGS. 7 and 8, in still another preferred embodiment, there is no connecting segment mounted between each fixing segment 12A and abutting wall 111A of the looped frame 10A. Correspondingly, there is no notch formed on the base card 20A so the shape of the base card 20A is kept intact. Specifically, the connecting segments which are formed between the fixing segments 12A and the abutting wall 111A will be removed after the looped frame 10A, which is produced by injection molding, is demoulded. The followings are the advantages of the hanging decorative accessory of the present invention. The looped frame 10, 10A is an integrally formed single unit. During assembly, the user only needs to mount the periphery 21 of the base card 20, 20A between the abutting wall 111, 111A of the looped frame 10, 10A and the fixing segments 12, 12', 12A, and then pushes the whole periphery 21 of the base card 20, 20A into the inner groove 11 of the looped frame 10, 10A, and the assembly process is done without any tool such as a screwdriver. Even children can complete the assembly process themselves, and enjoy the sense of accomplishment about the independent work. Furthermore, as the hanging decorative accessory in accordance with the present invention only comprises a looped frame 10, 10A and a base card 20, the structure is simple and even if some components are missing, the hanging decorative accessory can still can be assembled firmly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hanging decorative accessory comprising:

a looped frame having an inner groove formed in an inner looped surface of the looped frame, formed through a back looped surface of the looped frame, and forming an abutting wall; and an extending wall located between the abutting wall and the back looped surface of the looped frame and connecting the abutting wall and the back looped surface of the looped frame; and multiple fixing segments mounted on the extending wall of the inner groove and spaced apart from each other; each one of the multiple fixing segments extending along a radial direction of the looped frame and spaced apart from the abutting wall of the inner groove; and a base card mounted in the looped frame and having a periphery engaging the inner groove of the looped frame and mounted between the abutting wall and the fixing segments of the looped frame;

wherein each one of the fixing segments is connected to the abutting wall by a respective connecting segment; and the base card further comprises multiple notches formed in the periphery of the base card, spaced apart from each other, and corresponding in position to the fixing segments of the looped frame; the connecting segments of the looped frame engaging the notches of the base card respectively.

2. The hanging decorative accessory as claimed in claim 1, wherein an angle between the abutting wall and the extending wall of the looped frame is an acute angle.

3. The hanging decorative accessory as claimed in claim 2, wherein the multiple fixing segments comprise two fixing segments located in two opposite positions on the looped frame respectively; and the multiple notches comprise two notches located in two opposite positions on the periphery of the base card respectively.

4. The hanging decorative accessory as claimed in claim 3, wherein a distance for one of the fixing segments to extend along the radial direction is longer than a distance for the other one of the fixing segments to extend along the radial direction.

5. The hanging decorative accessory as claimed in claim 4, wherein the looped frame has a hanging segment mounted on an outer looped surface of the looped frame.

6. The hanging decorative accessory as claimed in claim 1, wherein the abutting wall is perpendicular to the extending wall of the looped frame.

7. The hanging decorative accessory as claimed in claim 6, wherein the multiple fixing segments comprise two fixing segments located in two opposite positions on the looped frame respectively; and the multiple notches comprise two notches located in two opposite positions on the periphery of the base card respectively.

8. The hanging decorative accessory as claimed in claim 7, wherein a distance for one of the fixing segments to extend along the radial direction is longer than a distance for the other one of the fixing segments to extend along the radial direction.

9. The hanging decorative accessory as claimed in claim 8, wherein the looped frame has a hanging segment mounted on an outer looped surface of the looped frame.

10. The hanging decorative accessory as claimed in claim 1, wherein the multiple fixing segments comprise two fixing segments located in two opposite positions on the looped frame respectively; and the multiple notches comprise two notches located in two opposite positions on the periphery of the base card respectively.

11. The hanging decorative accessory as claimed in claim 1, wherein the looped frame has a hanging segment mounted on an outer looped surface of the looped frame.

12. A hanging decorative accessory comprising:

a looped frame having an inner groove formed in an inner looped surface of the looped frame, formed through a back looped surface of the looped frame, and forming an abutting wall; and an extending wall located between the abutting wall and the back looped surface of the looped frame and connecting the abutting wall and the back looped surface of the looped frame; and multiple fixing segments mounted on the extending wall of the inner groove and spaced apart from each other; each one of the multiple fixing segments extending along a radial direction of the looped frame and spaced apart from the abutting wall of the inner groove; and a base card mounted in the looped frame and having a periphery engaging the inner groove of the looped frame and mounted between the abutting wall and the fixing segments of the looped frame;

wherein the multiple fixing segments comprise two fixing segments located in two opposite positions on the looped frame respectively; and a distance for one of the fixing segments to extend along the radial direction is longer than a distance for the other one of the fixing segments to extend along the radial direction.

* * * * *